United States Patent [19]

Nielsen

[11] Patent Number: 5,029,421

[45] Date of Patent: Jul. 9, 1991

[54] MODULAR GANTRY AND STRUCTURAL ELEMENT THEREFOR

[75] Inventor: Deniel M. Nielsen, Wacol, Australia

[73] Assignee: Speedy Gantry Hire Pty. Ltd., Australia

[21] Appl. No.: 408,200

[22] Filed: Sep. 18, 1989

[51] Int. Cl.[5] ..... E04B 9/00

[52] U.S. Cl. ..... 52/126.5; 52/263; 52/638

[58] Field of Search ..... 182/178, 222; 52/263, 52/126.5, 126.1, 126.7, 637, 638

[56] References Cited

U.S. PATENT DOCUMENTS

| | | | |
|---|---|---|---|
| 2,982,379 | 5/1961 | Fisher | 182/178 X |
| 3,360,288 | 12/1967 | Holscher | 52/637 X |
| 3,438,160 | 4/1969 | Gostling | 52/126.7 |
| 4,773,506 | 9/1988 | Preston | 182/178 X |

FOREIGN PATENT DOCUMENTS

| | | |
|---|---|---|
| 422512 | 12/1946 | Italy . |
| 414127 | 10/1964 | Switzerland . |

*Primary Examiner*—Richard E. Chilcot, Jr.
*Assistant Examiner*—Linda J. Watson
*Attorney, Agent, or Firm*—Wood, Phillips, Mason, Recktenwald & VanSanten

[57] ABSTRACT

A structural element (10) which can be used to modify the loading characteristics of a gantry module (18). The element (10) is securable between legs (22) so that for a standardized roof assembly (19) the gantry module (24) constructed using the structural element can span a greater distance with comparable loading characteristics with modules (18) which have a greater number of supporting legs. The structural element (10) has particular application is modifying a standard gantry module (18) into a vehicle access module (24) without compromising loading characteristics.

5 Claims, 2 Drawing Sheets

MODULAR GANTRY AND STRUCTURAL ELEMENT THEREFOR

This invention relates to improvements to scaffolding and in particular to an improved scaffolding gantry suitable particularly for erection on a footpath say to allow pedestrian passage thereunder but to protect pedestrians from possible falling debris associated with building construction or demolition.

Commonly, scaffolding gantries are formed from a plurality of scaffolding elements including a number of upright pipe members and a plurality of ledges which are interconnected in such a fashion as to form on a footpath a passageway or tunnel through which pedestrians may pass. The conventional type of scaffolding gantry as above has a number of disadvantages. In particular, the footpath area upon which the scaffolding is to be erected has to be hired from the relevant Local Authority from the commencement of the erection of the gantry and as erection often takes up to four weeks, four weeks' hire of the footpath is required before erection or demolition of a building can commence. Furthermore as an extended erection period is required, labour costs are particularly high and the scaffolding gantry if not satisfactory to the relevant authorities, may require to be disassembled and re-erected after inspection.

Normally scaffolding gantries of the above form are assembled from a plurality of scaffolding components which are simply dumped on site and after completion of a building work, those components are required to be disassembled, repaired if necessary and delivered back to the hirer thereof and costs are often associated with repair of such components or replacement thereof in the event of missing components.

Australian Patent Application No. 578,176 describes an alternative form of gantry which employs a plurality of gantry modules. The gantry modules are constructed from a minimum number of components including a roof assembly having a plurality of upstanding members to which legs and foot assemblies can be secured.

The gantry modules of 578,176 can be formed into a gantry assembly in much less time than was customary in the prior art.

The gantry of 578,176 has great value insofar as the parts of the modules are essentially interchangeable. The gantry constructed from such parts is a uniform gantry assembly having uniform structural characteristics such as loading capacity throughout the gantry.

This uniformity creates a problem with the system of 578,176 insofar as the gantry modules are not readily adaptable to gantries which require say a vehicle access bridge.

In this case leg spacing of the vehicle access bridge is usually greater than in other parts of the gantry thus creating a variation in the required loading capacity of the gantry at the location of the access bridge.

In addition, the roof assembly associated with the access bridge is usually higher than the roof assemblies of other parts of the gantry.

Thus there has been a need to provide a fabricated access bridge as an independent module having the required loading capacity.

While the provision of a specialised module for vehicle access is one solution to the problem, this solution has a number of disadvantages.

Modular gantries of this type are usually provided by gantry hire services.

The hire service holds an inventory of the various parts which make up the gantry modules. Separate inventories of standard and vehicle access modules are required. The number of vehicle access modules and standard modules required in the inventory is dependant on a number of variables. The main variable is the site size or the number of modules required per site. Normally one vehicle access module is required per site.

Hence if many small size gantries were to be provided by say a gantry module hire service at one time, a relatively small inventory of vehicle access modules could be depleted leaving a surplus of standard modules. On the other hand where many large gantries were to be provided at one time the same inventory of vehicle access modules would be in excess.

The present invention offers an alternative solution by providing a structural element which when used with a module changes the structural characteristics of the module. The resultant module can then be used as say a vehicle access bridge.

In one broad aspect therefor, the present invention resides in a structural element for use with a gantry module, said gantry module comprising a plurality of upstanding support members or legs and a roof assembly secured to and supported by said legs, said structural element comprising a span section removably securable to said gantry module so as to span between at least two of said legs or support members at a location closely spaced from said roof assembly.

In another aspect, the invention resides in a structural element when used with a gantry module, said gantry module having a roof assembly and a plurality of spaced legs supporting the roof assembly, said legs comprising an upper leg portion rigidly secured to the roof assembly and one or more interconnected lower leg portion removably secured in turn to an adjacent leg portion, said structural element comprising a span section removably securable to said gantry module so as to span between at least two of said legs.

In a still further aspect, the present invention resides in a modular gantry comprising a plurality of gantry modules, each said gantry module having a roof assembly and a plurality of spaced legs supporting the roof assembly, a structural element for changing the structural characteristics of one of said gantry modules, said structural element being removably securable to said gantry module between at least two of said legs so as to increase the loading capacity of the module, said structural element comprising a span section removably securable to said gantry module so as to span between said at least two legs adjacent said roof assembly.

The roof assembly can be made from a substantially rectangular sheet of steel supported by suitable bracing. The upstanding members or legs can comprise a plurality of detachable leg segments securable to the roof assembly.

The upstanding members or legs can be made from box section steel a part of which can be welded to and be part of the roof assembly. Leg segments can be employed to increase the length of the upstanding members. The leg segments can be located between the roof assembly and a foot assembly.

The span section can be an elongate member having a connector assembly at each end. The connection assembly can comprise opposed spaced plates secured to the elongate member. The opposed plates can include aligned securing holes alignable with holes on the legs or support members. The elongate member can have at least one depending member located intermediate its ends. The depending member can be securable to the roof assembly. The depending member can be of box section metal and be slidably receivable in the roof assembly.

In one preferred form the span section is of box section metal having one depending member and is a general T-shape. In another form the span section has two depending members, one at one end of the elongate member resulting in a general F-shape. In a still further form the span section has four depending members, two at each end, and generally I-shaped.

In order that the invention can be more readily understood and be put into practical effect, reference will now be made to the accompanying drawings and wherein.

Figure 1:
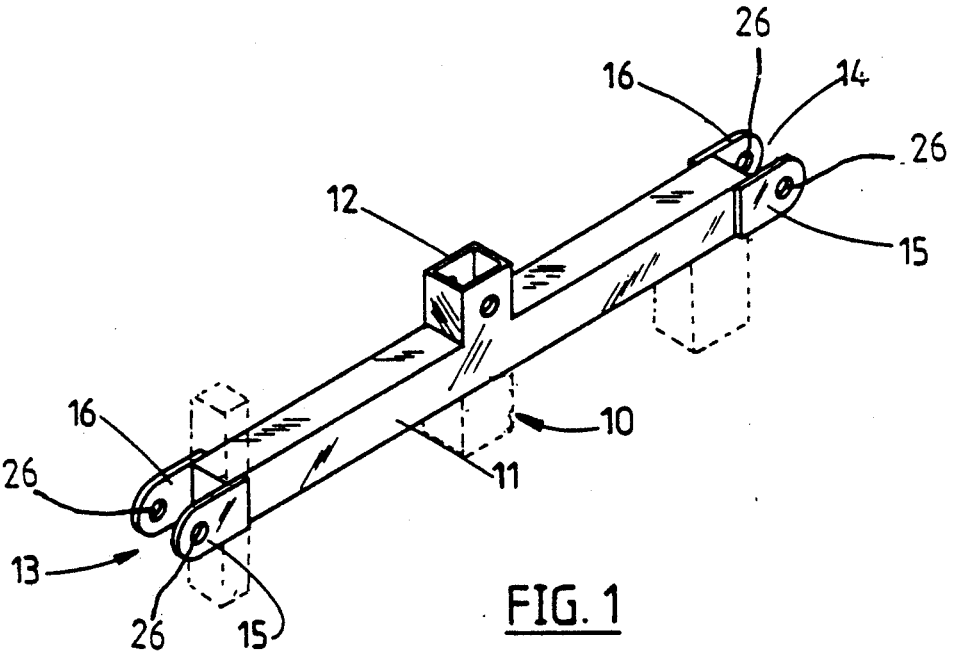
FIG. 1 is a perspective view illustrating one preferred structural element according to the invention.

Referring to the drawings and initially to FIG. 1, there is illustrated a structural element 10 constructed in accordance with the present invention.

The structural element 10 comprises an elongate span section 11 having connection assemblies 13 and 14 at its ends. A depending member 12 is located intermediate the connection assemblies 13 and 14. The span section is of general T-shape but it will be realised that other shapes can be derived by employing more depending members 12. Some examples are shown in broken outline and include F and I shaped structural elements.

The span section 11 is preferably constructed from box-section steel but this is not essential. Similarly the depending members are preferably constructed from box section steel.

The connection assemblies in the illustrative embodiment comprise opposed fish-plates 15 and 16 welded to the box section steel. The fish-plates 15 and 16 include securing holes 26. The depending member 12 can also be constructed from opposed fish plates.

Figure 2:
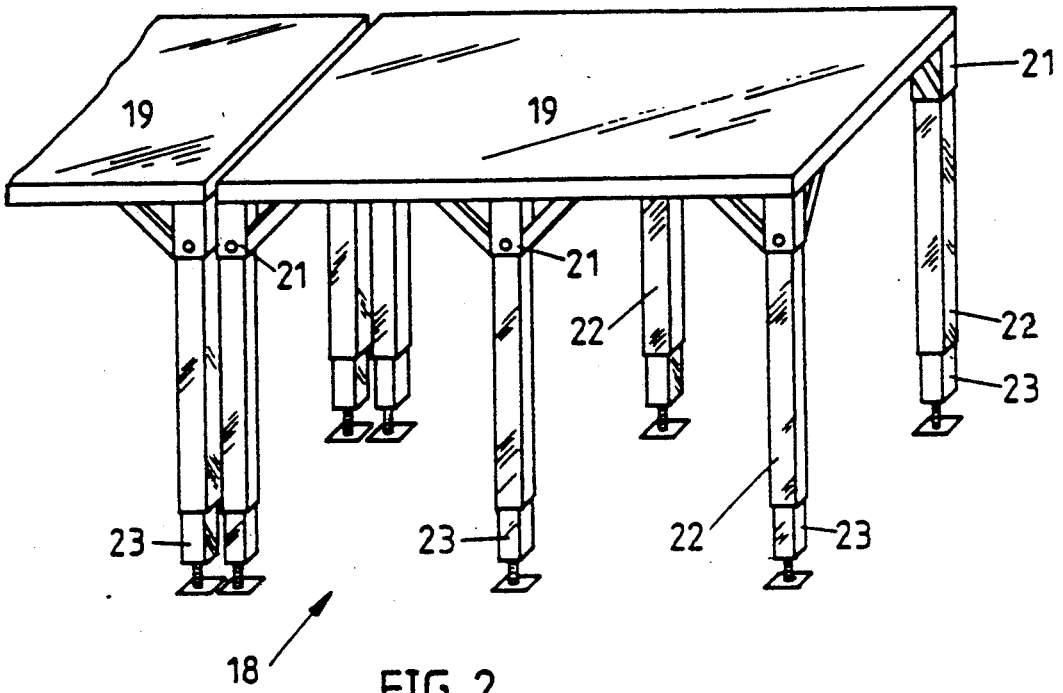
FIG. 2 is a perspective view illustrating part of a gantry assembly employing gantry modules as known in the prior art.

Referring to FIG. 2 there is illustrated part of a gantry assembly employing gantry modules known in the prior art.

Each gantry module 18 includes a plurality of upstanding members or legs which in this case comprise three sections, upper leg section 21 welded as part of the roof assembly 19, intermediate leg segments 22 and a foot assembly 23.

In each case the intermediate segment 22 is removably received in the upper leg portion 21 and the foot assembly 23 is removably received in the intermediate leg segment 22. Any number of leg segments 22 can be employed to vary the height of the roof assembly above foot assembly 23.

Figure 3:
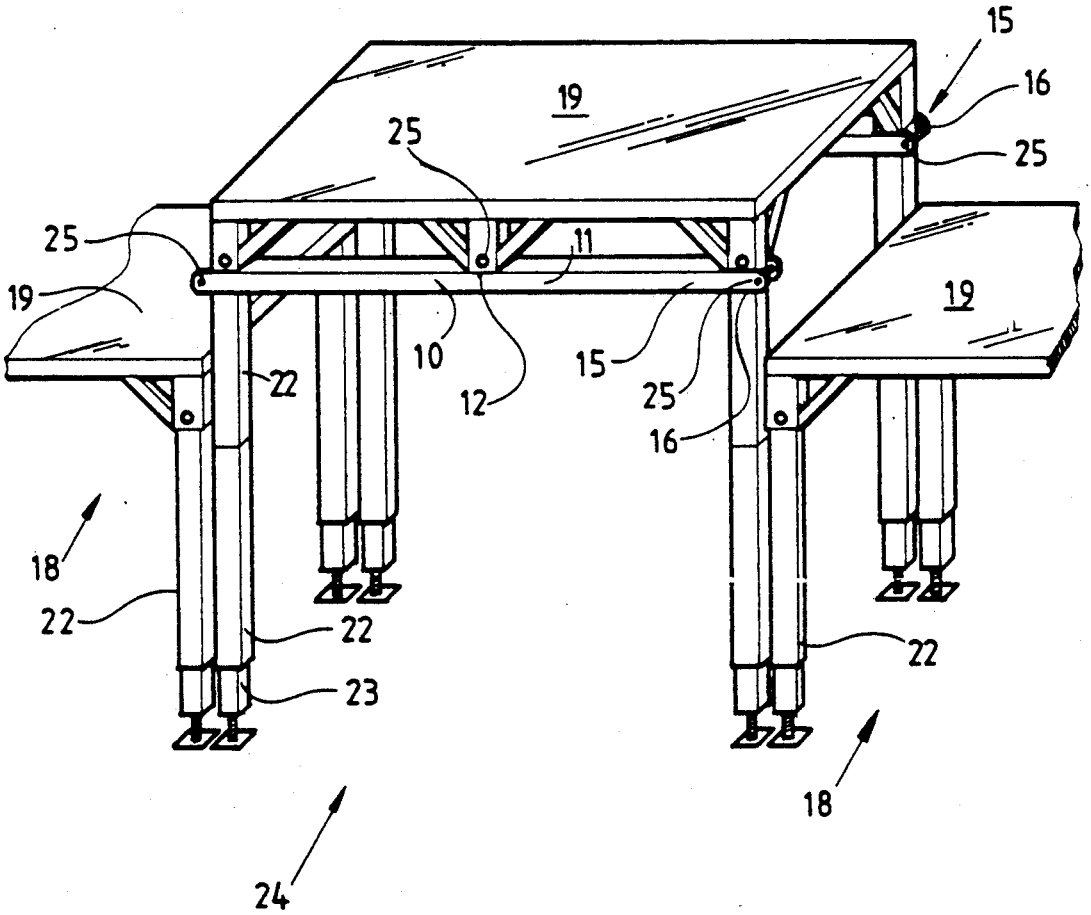
FIG. 3 is a perspective view illustrating part of a gantry assembly employing the structural element of FIG. 1.

Referring to FIG. 3 there is illustrated part of a gantry assembly employing the structural element of FIG. 1. Like numerals have been used to illustrate like features.

As can be seen the same form of roof assemblies 19 as used in the construction of modules 18 is also used in construction of module 24. Module 24 however employs eight leg segments 22. In the illustrated embodiment the module 24 is a vehicle access bridge.

Structural elements 10 have been employed at the front and rear of module 24 to provide sufficient load bearing capacity at the vehicle access bridge. The fish plates 15 and 16 and the depending member 12 of element 10 are secured in position using bolts 25. The depending member 12 is secured in an upper section 21 of the roof assembly. The fish plates 15 and 16 are secured by bolts 25 which pass outside the upper leg sections 21 but it will be realised that in an alternative form the bolts 25 can pass through holes in the upper leg sections 21. The structural element 10 is shown spaced from the upper leg section 21 but it can abut the upper leg sections 21 by sliding the depending member 12 further into the central upper leg section 21. Accordingly, the depending member can be made of various lengths according to the structural requirements.

Thus, the roof assemblies 19 can be used interchangeably between standard modules such as 18 or in specialised modules such as a vehicle access bridge 24 simply by employing structural element 10.

It will be realised that an inventory of structural elements 10 is a more economic proposition than maintaining an inventory of specialised modules.

The present invention can be employed whenever it is desirable to increase leg spacing beyond that provided by the standard module. It will be appreciated therefore that the invention has other applications and is not limited to vehicle access bridges.

The claims defining the invention are as follows:

1. A modular gantry comprising a plurality of gantry modules, each said gantry module having a roof assembly and a plurality of spaced legs supporting the roof assembly, a structural element for changing the structural characteristics of one of said gantry module, said structural element being removably securable to said gantry module between at least two of said legs so as to increase the loading capacity of the module, said structural element comprising a span section removably securable to said gantry module so as to span between said at least two legs adjacent said roof assembly, there being cooperating means on the gantry module and structural element for selectively securing the structural element to the gantry module in an operative position thereon and for removing the structural element from its operative position on the gantry module with the legs and roof assembly assembled, wherein the roof assembly of each said gantry module is of identical unitary construction and has a roof panel and upper leg portions rigidly mounted to the roof panel, lower leg portions detachably securable to the upper leg portions, said structural member being removably secured to said upper leg portions so as to span said at least two legs at said upper leg portions, wherein said upper leg portions comprise hollow tube members and the span section of said structural member includes an elongate body having opposite ends, a connection assembly at each end and at least one depending member intermediate its end, said depending member being slidably received in at least one of said hollow tube member and said elongate body having its connection assemblies connected to the nearest legs adjacent said hollow tube member in which said depending member is secured.

2. A modular gantry as defined in claim 1 wherein each connection assembly comprises opposed spaced plates secured to and extending beyond the respective ends of said elongate body, opposed plates straddling said legs adjacent to said hollow tube member in which said depending member is secured, said opposed plates generally defining a U-shape.

3. A modular gantry as defined in any of claims 1 or 2 wherein said structural member is located adjacent said roof assembly and said one of said gantry modules is a vehicle access module.

4. A structural element when used with a gantry module, said gantry module having a roof assembly and a plurality of spaced legs supporting the roof assembly, said legs comprising an upper leg portion rigidly secured to the roof assembly and one or more interconnected lower leg portions removably secured in turn to an adjacent leg portion, said structural element comprising a span section removably secured to said gantry module so as to span between at least two of said legs adjacent said roof assembly, there being cooperating means on the gantry module and structural element for selectively securing the structural element to the gantry module in an operative position thereon and for removing the structural element from its operative position on the gantry module with the legs and roof assembly assembled, wherein the span section of said structural element includes an elongate body having opposite ends, a connection assembly at each end and at least one depending member intermediate its ends.

5. A structural element as defined in claim 4 wherein each connection assembly comprises opposed spaced plates secured to and extending beyond the respective ends of said elongate body, said opposed plates being adapted in use to straddle a said leg of a said module while said depending member is engaged with a said upper leg portion of said roof assembly, said opposed plates generally defining a U-shape at each end of the elongate body, with the U-shapes at the ends of the elongate body opening oppositely of each other.

* * * * *